US011002036B1

(12) United States Patent
Zhang et al.

(10) Patent No.: US 11,002,036 B1
(45) Date of Patent: May 11, 2021

(54) PULL-DOWN TYPE DEVICE THAT UNLOCKS LOCKING OF A PULL ROD IN A FOLDABLE TENT

(71) Applicant: Zhejiang Yitai Trade Co., Ltd., Zhejiang Province (CN)

(72) Inventors: Junhui Zhang, Zhejiang Province (CN); Yu Chen, Zhejiang Province (CN); Suhua Wu, Zhejiang Province (CN)

( * ) Notice: Subject to any disclaimer, the term of this patent is extended or adjusted under 35 U.S.C. 154(b) by 0 days.

(21) Appl. No.: 16/860,058

(22) Filed: Apr. 27, 2020

(30) Foreign Application Priority Data

Dec. 10, 2019 (CN) ..... 201922199444.3

(51) Int. Cl.
*E04H 15/48* (2006.01)

(52) U.S. Cl.
CPC ..... *E04H 15/48* (2013.01)

(58) Field of Classification Search
CPC ..... E04H 15/48
See application file for complete search history.

(56) References Cited

U.S. PATENT DOCUMENTS 5,499,646 A * 3/1996 Lee ..... E04H 15/28 135/121
10,060,153 B2 * 8/2018 Song ..... E04H 15/50
10,107,005 B2 * 10/2018 Song ..... E04H 15/44
10,273,710 B2 * 4/2019 Yang ..... E04H 15/50
10,669,738 B2 * 6/2020 Yang ..... E04H 15/48
10,822,829 B1 * 11/2020 Lu ..... E04H 15/48
2019/0368232 A1 * 12/2019 Sun ..... E05B 65/00
2020/0181939 A1 * 6/2020 Ying ..... E04H 15/28
2020/0240167 A1 * 7/2020 Sun ..... E04H 15/32
2020/0240168 A1 * 7/2020 Sun ..... E04H 15/50
2020/0347635 A1 * 11/2020 Sun ..... E04H 15/48

* cited by examiner

*Primary Examiner* — Noah Chandler Hawk

(74) *Attorney, Agent, or Firm* — Prakash Nama; Global IP Services, PLLC

(57) ABSTRACT

A pull-down type device, including a base, a supporting plate, two locking tongues slidably positioned on the supporting plate, a cap and a pull rod; the supporting plate is fixed to the cap; each locking tongue has a body, a latch, a vertical column, and a slanted surface at a bottom end of the vertical column; the latch passes through a reset spring abutting against an inner side of the cap; a column having a body and an accommodation space is provided at the center of the base; a protrusion of the pull rod is fitted in the space. The space has a diameter larger than the column; slanted surfaces are provided at outer surfaces of the space, slidably cooperating with the slanted surfaces of the vertical columns; the space is located beneath the body of the locking tongue. The pull rod can be unlocked by pulling down the base.

5 Claims, 10 Drawing Sheets

PULL-DOWN TYPE DEVICE THAT UNLOCKS LOCKING OF A PULL ROD IN A FOLDABLE TENT

BACKGROUND OF THE INVENTION

The present invention relates to the field of foldable tents, and more specifically relates to a pull-down type device that unlocks locking of a pull rod in a foldable tent.

A foldable tent is unfolded during use, and can be folded and stored when it is not in use. A foldable tent can block against sunlight and rain, and has the advantages of being portable. Therefore, foldable tent is widely used in daily lives.

Currently, the process of folding a foldable tent is complicated which involves many steps. Also, due to the general large size of the tent, manipulation cannot be achieved by a single person. It requires two or more people to fold the tent in order to be effort saving. When unfolding the tent, the tent has to be locked at multiple areas, and likewise, unlocking is required at these multiple areas when folding the tent. Therefore, it is inconvenient to use the tent.

BRIEF SUMMARY OF THE INVENTION

An object of the present invention is to overcome the aforesaid disadvantages now present in the prior art.

To fulfil the object present invention, a pull-down type device that unlocks locking of a pull rod in a foldable tent is provided, comprising a movable element base, a locking tongue supporting plate, two symmetrically arranged locking tongues, a movable element cap, and a pull rod; the movable element base and the movable element cap are connected via fasteners and springs, and a movement cavity is formed inside a space of the connected movable element base and the movable element cap; the locking tongue supporting plate is fixed to the movable element cap; sliding grooves are provided between the locking tongue supporting plate and the movable element cap, and the two locking tongues are slidably positioned in the sliding grooves respectively; each of the locking tongues comprises a locking tongue body, a locking latch on one lateral side of the locking body, and a vertical column on a bottom side of the locking tongue body; the vertical column passes through the locking tongue supporting plate; a locking tongue slanted surface is arranged at a bottom free end of the vertical column; another lateral side of the locking body is provided with a semi-funnel shape trough; the locking latch passes through a corresponding locking tongue reset spring, while an end of the locking tongue reset spring away from the corresponding locking tongue abuts against an inner side wall of the movable element cap; a central part of the movable element base is provided with a central column; the central column comprises a central column body and an accommodation space provided at a top end of the central column body; a pull rod protrusion at a bottom free end of the pull rod is fitted in the accommodation space; wherein the accommodation space has a diameter larger than a diameter of the central column body; central column slanted surfaces are provided on outer surfaces of the accommodation space extending to outer surfaces of the central column body; the central column slanted surfaces are slidably cooperative with the locking tongue slanted surfaces of the locking tongues; the accommodation space is located beneath the locking tongue bodies and between the two vertical columns of the locking tongues; under down pulling force of pulling down the movable element base, the central column slanted surfaces slide down along the corresponding locking tongue slanted surfaces to apply opposite outward pushing lateral forces towards the two locking tongues respectively, such that the two locking tongues overcome the biasing forces of the locking tongue reset springs and thus being pushed away laterally from each other, and hence the two locking tongue bodies are also separated from each other, and the pull rod protrusion at the bottom free end of the pull rod is capable of being disengaged from the locking tongues to achieve unlocking of the pull rod.

In another possible embodiment, a through hole is provided in a middle part of the locking tongue supporting plate; two first sliding grooves are symmetrically arranged at two sides of the through hole respectively; the movable element cap is provided with a second sliding groove corresponding to the through hole, and third sliding grooves corresponding to the first sliding grooves; the vertical columns of the locking tongues pass through the through hole, such that the locking latches of the locking tongues are slidably fitted into the first sliding grooves respectively and the corresponding third sliding grooves respectively, while the locking tongue bodies of the locking tongues are slidably fitted into the second sliding groove.

In another possible embodiment, the locking tongue supporting plate is fixed to the movable element cap through fasteners.

In another possible embodiment, the fasteners are screws.

In another possible embodiment, a top end of the pull rod is connected with a top cap.

The present invention can directly achieve unlocking of the pull rod by a down pulling action. Therefore, the present invention can be operated easily with direct and straightforward convenience.

BRIEF DESCRIPTION OF THE DRAWINGS

In order to explain clearly the technical solution provided by the embodiments of the present invention, the drawings required to illustrate the embodiments will be briefly described below. Obviously, the drawings described below are intended to illustrate only some of the possible embodiments of the present invention. A person skilled in the art will understand that other drawings can be obtained based on the given drawings, given that they are obtained without any further inventive effort.

References in the figures.

Figure 1:
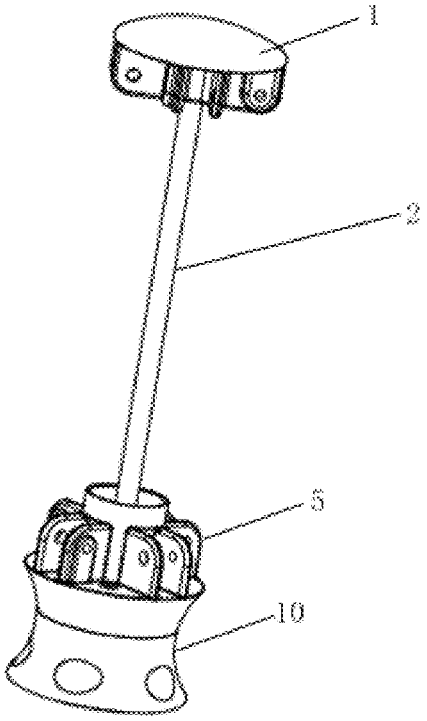
FIG. 1 is a schematic structural view of a pull-down type device that unlocks locking of a pull rod in a foldable tent according an embodiment of the present invention.
Figure 2:
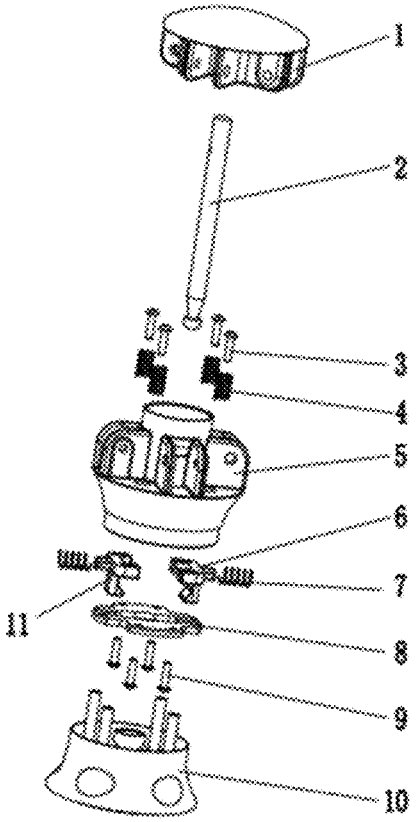
FIG. 2 is an exploded structural view of FIG. 1.

1—top cap; 2—pull rod; 3—first screw; 4—spring; 5—movable element cap; 6—locking tongue; 7—locking tongue reset spring; 8—locking tongue supporting plate; 9—second screw; 10—movable element base;

51—second sliding groove; 52—third sliding groove;

61—locking tongue body; 62—locking latch; 63—vertical column; 64—locking tongue slanted surface; 611—semi-funnel shape trough;

21—pull rod protrusion;

101—central column; 1011—central column body; 1012—accommodation space; 1013—central column slanted surface;

81—through hole; 82—first sliding groove.

DETAILED DESCRIPTION OF THE INVENTION

Technical terms appearing in the description of the embodiments, the claims and the drawings, such as "first", "second", are intended to distinguish similar components, but not necessarily intended to mean a particular sequence or order. Besides, technical terms such as "comprise" and "include" and any other variants thereof are intended to be non-exclusive, for example, by comprising a series of steps or units. Methods, systems, products or apparatus are not limited to those clearly listed steps or units, but may also include non-listed steps or units or other steps or units already known to the processes, methods, systems, products or apparatus.

The technical solutions provided the present invention will be further described in detail below with reference to the drawings and embodiments.

As shown in FIGS. 1-17, the present invention provides a pull-down type device that unlocks locking of a pull rod in a foldable tent, comprising a movable element base 10, a locking tongue supporting plate 8, two symmetrically arranged locking tongues 6, a movable element cap 5, a pull rod 2 and a cap 1.

The movable element base 10 and the movable element cap 5 are connected via first screws 3 and springs 4, and a movement cavity is formed inside a space of the connected movable element base and the movable element cap; the springs 4 serve the purpose of resetting the movable element base 10; in the absence of the springs 4, the movable element base 10 will be in a sagged condition due to gravity; in the presence of the springs 4, the springs 4 bias the movable element base 10 towards the movable element cap.

The locking tongue supporting plate 8 is fixed to the movable element cap 5 through second screws 9; sliding grooves are provided between the locking tongue supporting plate 8 and the movable element cap 5, and the two locking tongues are slidably positioned in the sliding grooves respectively.

Figure 3:
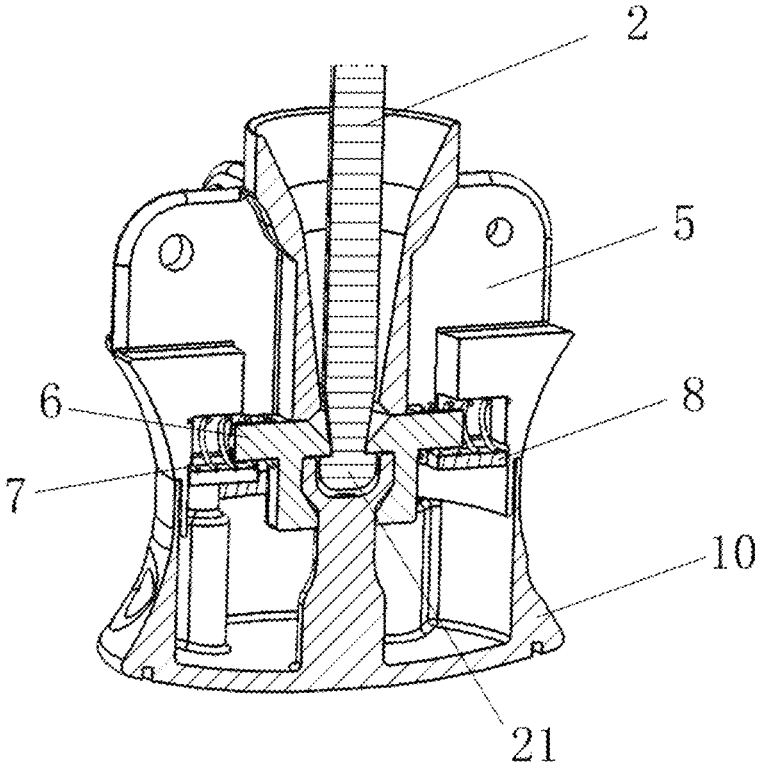
FIG. 3 is partial sectional view of the structure shown in FIG. 1.
Figure 4:
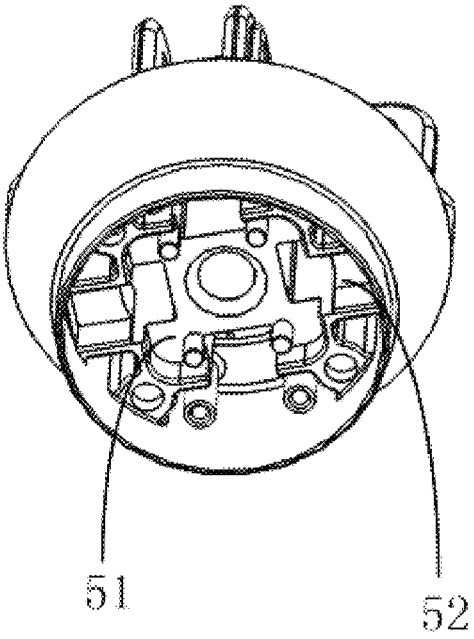
FIG. 4 s a schematic structural view of a movable element cap provided according to an embodiment of the present invention.
Figure 7:
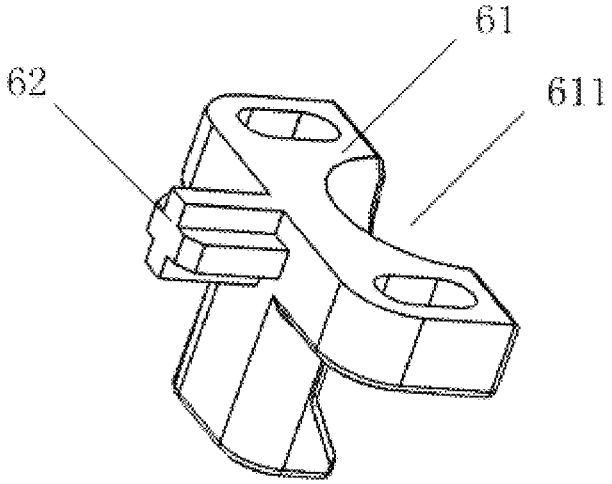
FIG. 7 is a schematic structural view of a locking tongue according to an embodiment of the present invention.
Figure 8:
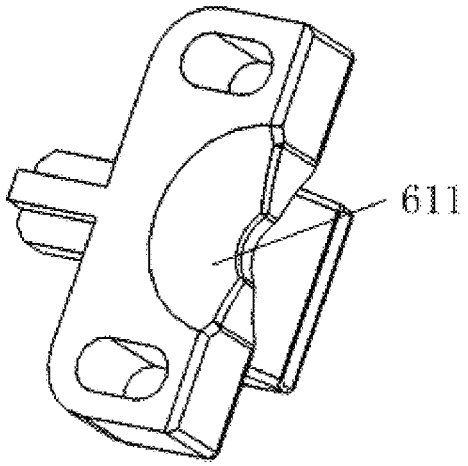
FIG. 8 is another schematic structural view showing the locking tongue according to an embodiment of the present invention in an alternative angle.
Figure 9:
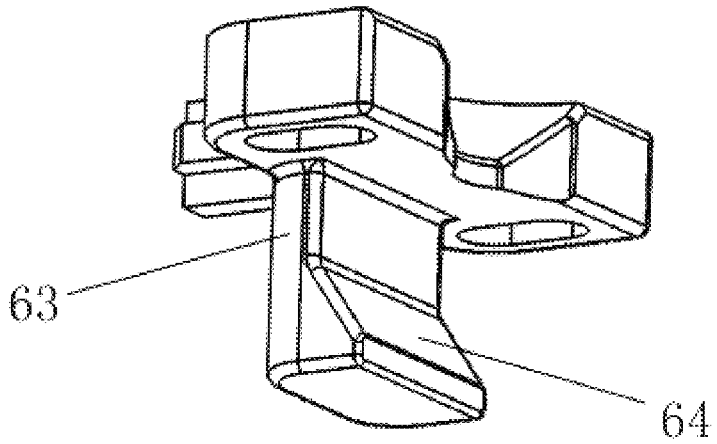
FIG. 9 is still another schematic structural view showing the locking tongue according to an embodiment of the present invention in a further alternative angle.
Figure 10:
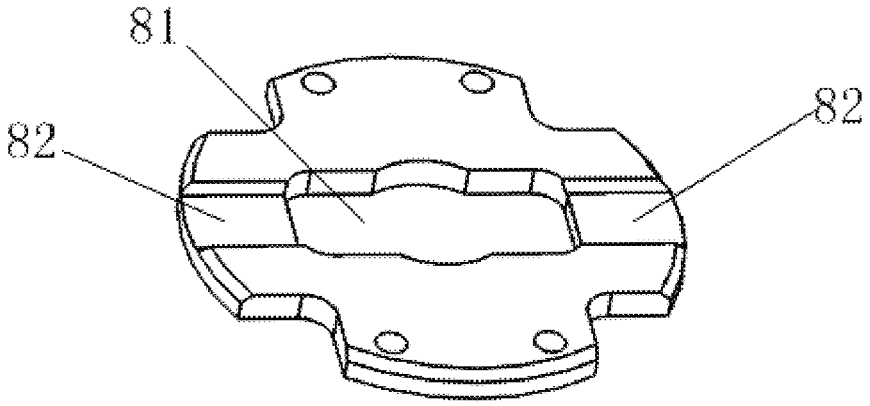
FIG. 10 is a schematic structural view of a locking tongue supporting plate according an embodiment of the present invention.

As shown in FIGS. 7-9, each of the locking tongues 6 comprises a locking tongue body 61, a locking latch 62 on one lateral side of the locking body 61, and a vertical column 63 on a bottom side of the locking tongue body 61; the vertical column 63 passes through the locking tongue supporting plate 8; a locking tongue slanted surface 64 is arranged at a bottom free end of the vertical column 63; another lateral side of the locking body 61 is provided with a semi-funnel shape trough 611; the semi-funnel shape trough 611 has a guiding effect upon the pull rod 2 upon insertion of the pull rod 2, so that insertion of the pull rod 2 is executed towards a single direction, and a slope surface of the semi-funnel shape trough is beneficial to pushing away the locking tongue body 61 for the pull rod 2 to pass through the locking tongue body 61. As shown in FIG. 3, the locking latch 62 passes through a corresponding locking tongue reset spring 7, while an end of the locking tongue reset spring 7 away from the locking tongue abuts against an inner side wall of the movable element cap 5.

Figure 5:
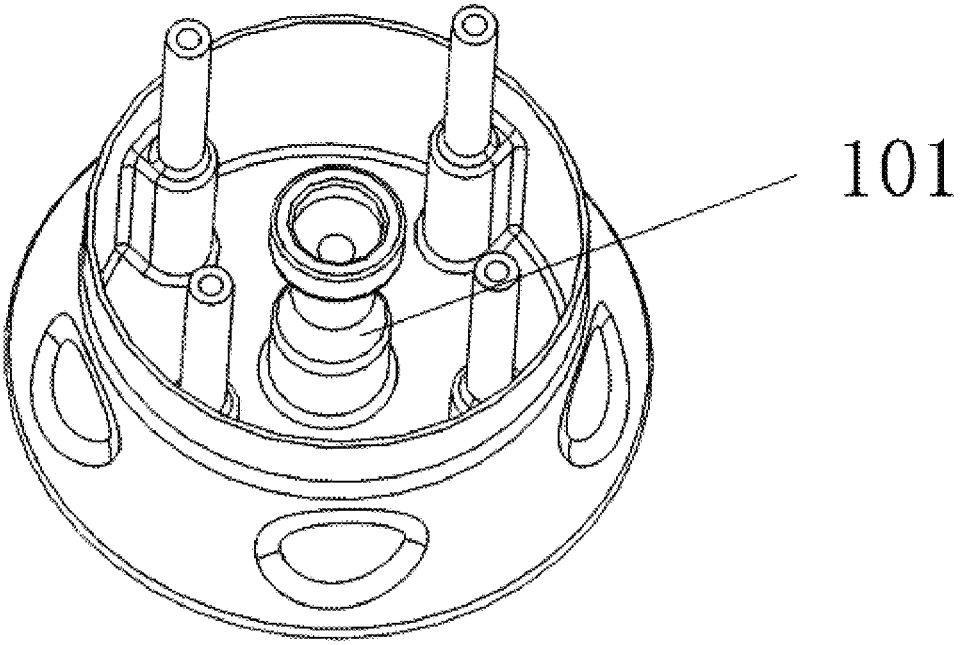
FIG. 5 is a schematic structural view of a movable element base provided according to an embodiment of the present invention.
Figure 6:
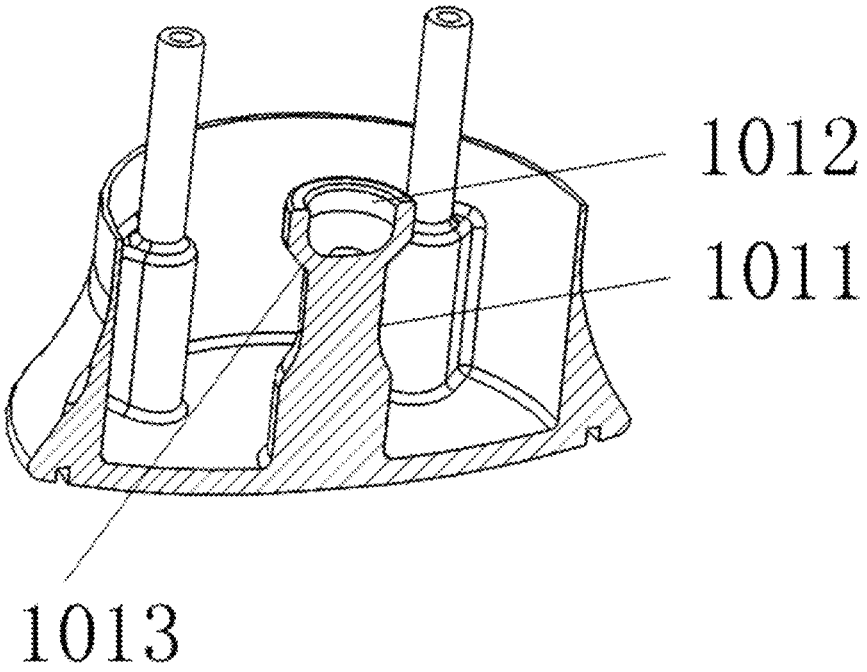
FIG. 6 is a sectional view of FIG. 5.

As shown in FIGS. 5-6, a central part of the movable element base 10 is provided with a central column 101; the central column 101 comprises a central column body 1011 and an accommodation space 1012 provided at a top end of the central column body 1011; a pull rod protrusion 21 at a bottom free end of the pull rod 2 can be locked in the accommodation space 1012; wherein the accommodation space 1012 has a diameter larger than a diameter of the central column body 1011; central column slanted surfaces 1013 are provided on outer surfaces of the accommodation space 1012 extending to outer surfaces of the central column body 1011; the central column slanted surfaces 1013 are slidably cooperative with the locking tongue slanted surfaces 64 of the locking tongues. The accommodation space 1012 is located beneath the locking tongue bodies 61 and between the two vertical columns 63 of the locking tongues.

Specifically, as shown in FIGS. 3, 4, 7-10, a through hole 81 is provided in a middle part of the locking tongue supporting plate 8; two first sliding grooves 82 are symmetrically arranged at two sides of the through hole 81 respectively; the movable element cap 5 is provided with a second sliding groove 51 corresponding to the through hole 81, and third sliding grooves 52 corresponding to the first sliding grooves 82; the vertical columns 63 of the locking tongues 6 pass through the through hole 81, such that the locking latches 62 of the locking tongues 6 are slidably fitted into the first sliding grooves 82 respectively and corresponding third sliding grooves 52 respectively, while the locking tongue bodies 61 of the locking tongues are slidably fitted into the second sliding groove 51.

Figure 11:
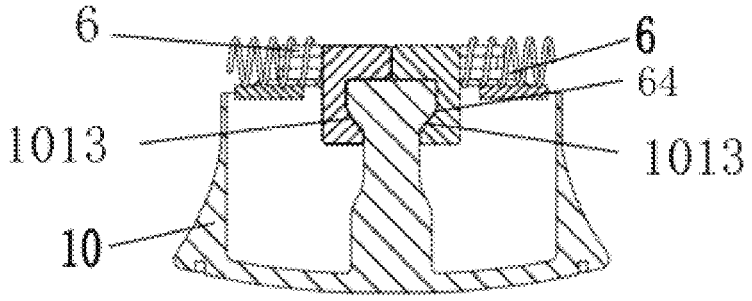
FIG. 11 illustrates the positions of the movable element base and the locking tongue under a locked condition.
Figure 12:
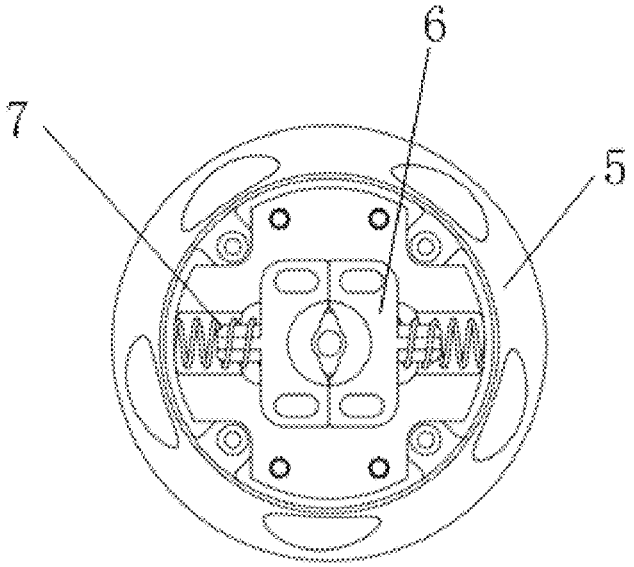
FIG. 12 is a top plan view of FIG. 11.
Figure 16:
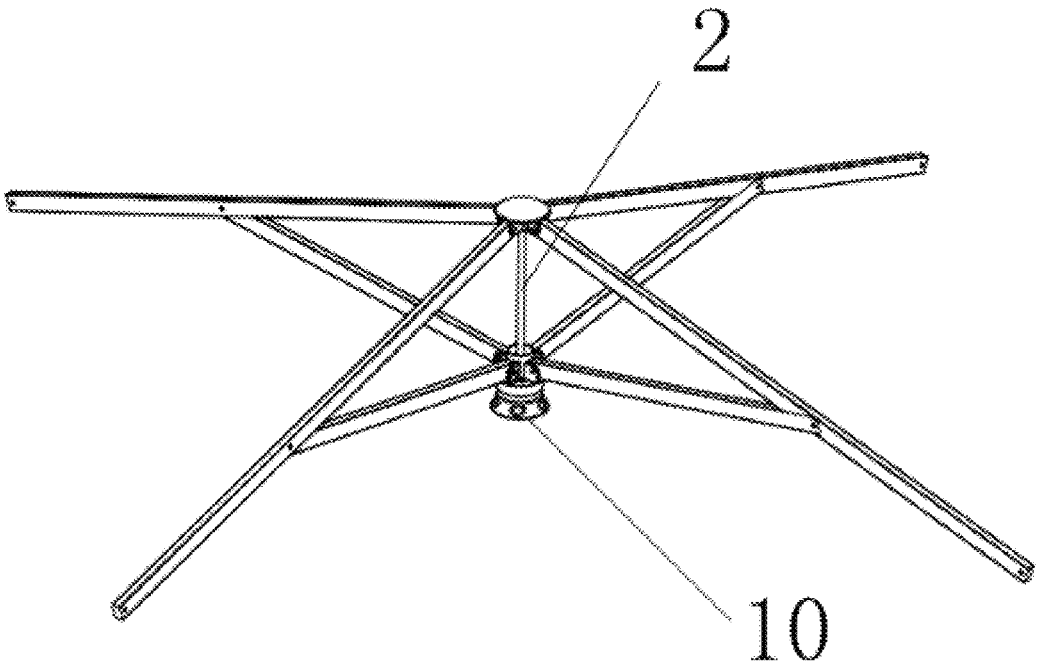
FIG. 16 is a partially enlarged view of FIG. 15, whereas the structure shown in FIG. 15 is in a locked condition.

Use of the present invention:

As shown in FIGS. 11, 12 and 16, under the biasing forces of the locking tongue reset springs 7 towards each other, the semi-funnel shape troughs 611 of the two symmetrically arranged locking tongues 6 abut against each other to form a complete funnel shape; the pull rod protrusion 21 at the bottom free end of the pull rod 2 is fitted into the accommodation space 1012 beneath the complete funnel shape formed by the abutted semi-funnel shape troughs. Due to the presence of the locking tongue reset springs 7, the pull rod protrusion 21 at the bottom free end of the pull rod 2 is locked beneath the locking tongue bodies 61 by the locking tongues 6. Therefore, the pull rod 2 is locked.

Figure 13:
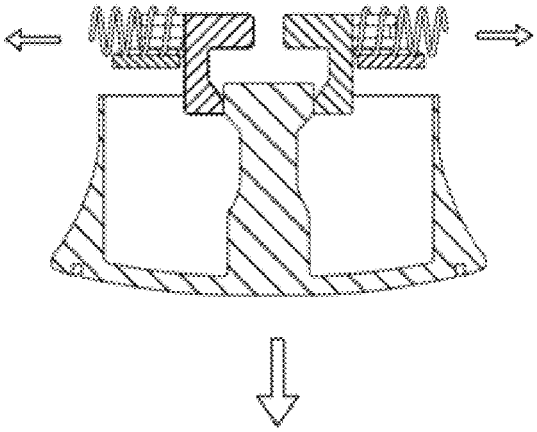
FIG. 13 illustrates the positions of the movable element base and the locking tongue under an unlocked condition.
Figure 14:
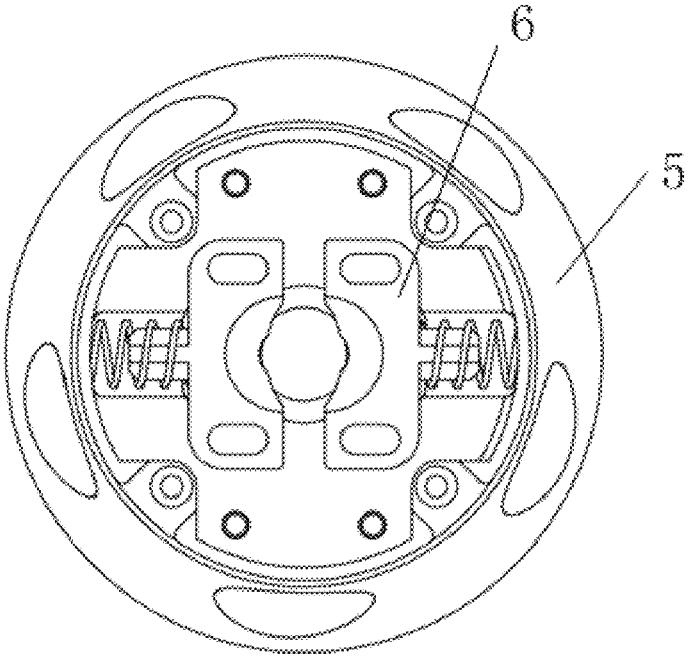
FIG. 14 is a top plan view of FIG. 13.
Figure 15:
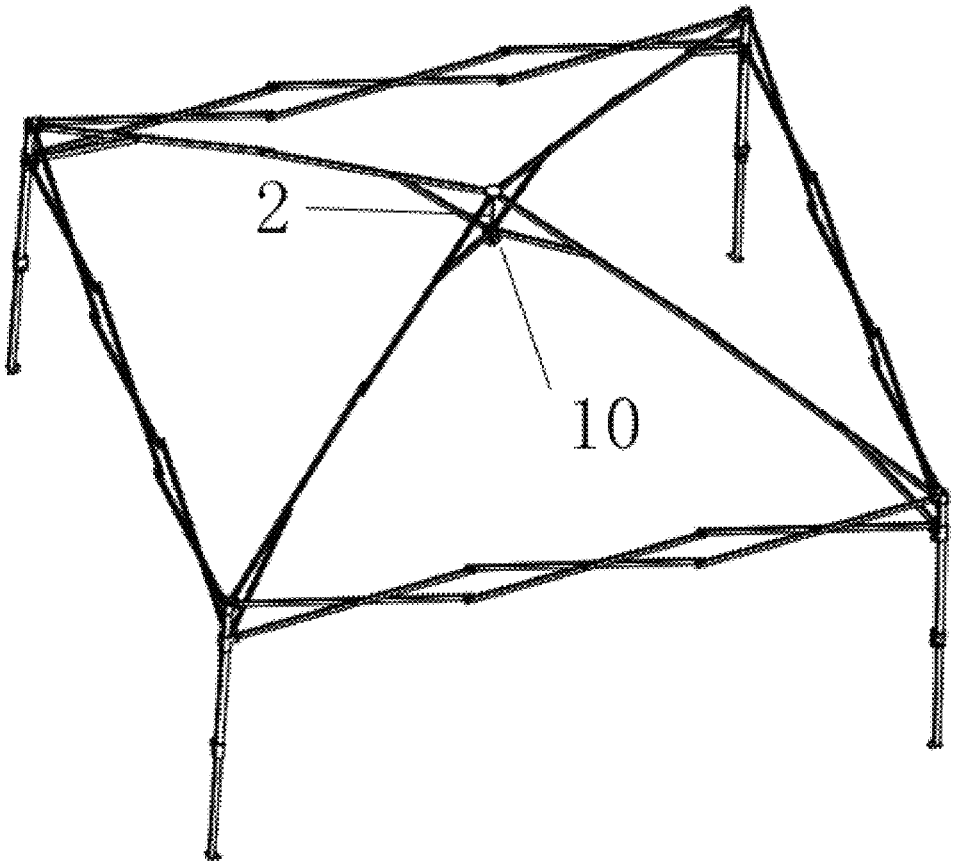
FIG. 15 is a view showing application of the pull-down device that unlocks locking of a pull rod in a foldable tent according to the present invention.
Figure 17:
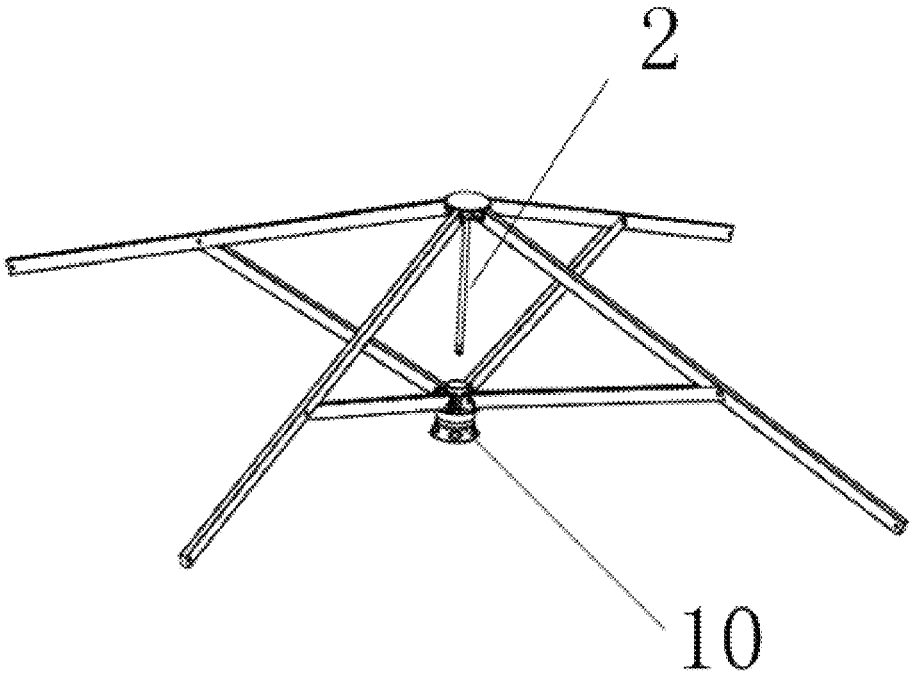
FIG. 17 is a partially enlarged view of FIG. 15, whereas the structure shown in FIG. 15 is in an unlocked condition.

As shown in FIGS. 13, 14 and 17, when the movable element base 10 is pulled down, the central column slanted surfaces 1013 slide down along the corresponding locking tongue slanted surfaces 64 to apply opposite outward pushing lateral forces towards the two locking tongues 6 respectively, such that the two locking tongues 6 overcome the biasing forces of the locking tongue reset springs 7 and thus being pushed away laterally from each other. When the two locking tongue bodies 61 separate from each other, the pull rod protrusion 21 at the bottom free end of the pull rod 2 can be disengaged from the locking tongues 6 and hence achieving unlocking.

The embodiments given above so that the object of the invention, the technical solutions of the present invention and the beneficial effects of the present invention are described in detail. However, it should be understood that the above description are only embodiments of the present invention and should not limit the scope of protection of the present invention. Any changes and modifications and the like having a basis on the technical solutions given by the present invention should also fall within the scope of protection of the present invention.

What is claimed is:

1. A pull-down type device that unlocks locking of a pull rod in a foldable tent, comprising a movable element base, a locking tongue supporting plate, two symmetrically arranged locking tongues, a movable element cap, and the pull rod;

the movable element base and the movable element cap are connected via fasteners and springs, and a movement cavity is formed inside a space of the connected movable element base and the movable element cap;

the locking tongue supporting plate is fixed to the movable element cap;

sliding grooves are provided between the locking tongue supporting plate and the movable element cap, and the two locking tongues are slidably positioned in the sliding grooves respectively;

each of the locking tongues comprises a locking tongue body, a locking latch on one lateral side of the locking body, and a vertical column on a bottom side of the locking tongue body; the vertical column passes through the locking tongue supporting plate; a locking tongue slanted surface is arranged at a bottom free end of the vertical column; another lateral side of the locking tongue body is provided with a semi-funnel shape trough; the locking latch passes through a corresponding locking tongue reset spring, while an end of the locking tongue reset spring away from the corresponding locking tongue abuts against an inner side wall of the movable element cap;

a central part of the movable element base is provided with a central column;

the central column comprises a central column body and an accommodation space provided at a top end of the central column body; a pull rod protrusion at a bottom free end of the pull rod is fitted in the accommodation space;

wherein the accommodation space has a diameter larger than a diameter of the central column body; central column slanted surfaces are provided on outer surfaces of the accommodation space extending to outer surfaces of the central column body; the central column slanted surfaces are slidably cooperative with the locking tongue slanted surfaces of the locking tongues;

the accommodation space is located beneath the locking tongue bodies and between the two vertical columns of the locking tongues;

under down pulling force of pulling down the movable element base, the central column slanted surfaces slide down along the corresponding locking tongue slanted surfaces to apply opposite outward pushing lateral forces towards the two locking tongues respectively, such that the two locking tongues overcome the biasing forces of the locking tongue reset springs and thus being pushed away laterally from each other, and hence the two locking tongue bodies are separated from each other, and the pull rod protrusion at the bottom free end of the pull rod is capable of being disengaged from the locking tongues to achieve unlocking of the pull rod.

2. The pull-down type device of claim 1, wherein a through hole is provided in a middle part of the locking tongue supporting plate; two first sliding grooves are symmetrically arranged at two sides of the through hole respectively; the movable element cap is provided with a second sliding groove corresponding to the through hole, and third sliding grooves corresponding to the first sliding grooves; the vertical columns of the locking tongues pass through the through hole, such that the locking latches of the locking tongues are slidably fitted into the first sliding grooves respectively and the corresponding third sliding grooves respectively, while the locking tongue bodies of the locking tongues are slidably fitted into the second sliding groove.

3. The pull-down type device of claim 1, wherein the locking tongue supporting plate is fixed to the movable element cap through fasteners.

4. The pull-down type device of claim 1, wherein the fasteners are screws.

5. The pull-down type device of claim 1, wherein a top end of the pull rod is connected with a top cap.

* * * * *